US012234062B1

(12) United States Patent
Carpenter

(10) Patent No.: US 12,234,062 B1
(45) Date of Patent: Feb. 25, 2025

(54) CLAMSHELL FOOD CONTAINER WITH DOUBLE LIDS

(71) Applicant: Blaine Carpenter, Ellisville, MS (US)

(72) Inventor: Blaine Carpenter, Ellisville, MS (US)

( * ) Notice: Subject to any disclaimer, the term of this patent is extended or adjusted under 35 U.S.C. 154(b) by 51 days.

(21) Appl. No.: 17/701,351

(22) Filed: Mar. 22, 2022

Related U.S. Application Data

(63) Continuation-in-part of application No. 29/829,348, filed on Mar. 4, 2022.

(51) Int. Cl.
*B65D 43/16* (2006.01)
*B65D 43/22* (2006.01)

(52) U.S. Cl.
CPC ..... *B65D 43/162* (2013.01); *B65D 43/22* (2013.01); *B65D 2543/00231* (2013.01); *B65D 2543/00351* (2013.01)

(58) Field of Classification Search
CPC ..... B65D 47/065; B65D 47/066; B65D 47/2031; B65D 25/40; B65D 25/44; B65D 25/46; B65D 39/00; B65D 47/06; B65D 47/061; B65D 51/00; B65D 51/16; B65D 83/00; A45F 3/20; A47G 19/2266; A47G 19/2272; A47G 19/22
See application file for complete search history.

(56) References Cited

U.S. PATENT DOCUMENTS

| | | | | |
|---|---|---|---|---|
| 2,591,471 | A * | 4/1952 | Schwertfeger ..... | B65D 85/324 206/521.1 |
| 3,580,480 | A * | 5/1971 | French ..... | B65D 85/324 206/521.1 |
| 5,012,971 | A | 5/1991 | Cozzi et al. | |
| 5,323,898 | A | 6/1994 | Kester | |
| 5,695,062 | A * | 12/1997 | Lemaire ..... | B65D 43/22 206/521.1 |
| 7,597,206 | B2 | 10/2009 | Atkins et al. | |
| 10,611,549 | B1 | 4/2020 | Mahon | |
| 2011/0210119 | A1 | 9/2011 | Clark | |
| 2011/0215097 | A1 | 9/2011 | Archie et al. | |
| 2014/0367302 | A1 | 12/2014 | Umholtz | |
| 2017/0166363 | A1 | 6/2017 | Ng | |

* cited by examiner

*Primary Examiner* — Shawn M Braden
(74) *Attorney, Agent, or Firm* — George L Williamson

(57) ABSTRACT

Method and apparatus for a clamshell food container having three portions including a bottom compartment and two top/upper compartments which would be normally thermal-formed wherein the top and bottom compartments are connected by integrally formed living hinge wherein the top compartment is formed of a first and a second opposing lid joined intermediately by a latch and slot assembly. The latch assembly includes interlocking tabs and slots and could be a single latch or a double latch assembly. The bottom portion also includes food dividers forming food compartments which could be made in different configurations.

6 Claims, 4 Drawing Sheets

CLAMSHELL FOOD CONTAINER WITH DOUBLE LIDS

BACKGROUND OF THE INVENTION

Field of the Invention

The present invention relates generally to clamshell containers, and more particularly, is concerned with a clamshell food container having double opposing lids.

Description of the Related Art

Devices relevant to the present invention have been described in the related art; however, none of the related art devices disclose the unique features of the present invention. In U.S. Patent Application Publication No. 2011/0215097 dated Sep. 8, 2011, Archie, Jr., et al., disclosed a dual compartment sandwich container and method of making same. In U.S. Patent Application Publication No. 2017/0166363 dated Jun. 15, 2017, Ng disclosed a clamshell food container. In U.S. Patent Application Publication No. 2011/0210119 dated Sep. 1, 2011, Clark disclosed a clamshell food tray with cup-based latch. In U.S. Patent Application Publication No. 2014/0367302 dated Dec. 18, 2014, Umholtz disclosed a multi-compartmented sandwich storage device. In U.S. Pat. No. 10,611,549 dated Apr. 7, 2020, Mahon disclosed a sandwich container. In U.S. Pat. No. 5,012,971 dated May 7, 1991, Cozzi, et al., disclosed a food container and method. In U.S. Pat. No. 7,597,206 dated Oct. 6, 2009, Atkins, et al., disclosed a container with one-step closing. In U.S. Pat. No. 5,323,898 dated Jun. 28, 1994, Kester disclosed a dual-hinged lid package.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a clamshell food container having three portions including a bottom compartment and two top/upper compartments or lids which would normally be thermal-formed wherein the top and bottom compartments are connected by integrally formed living hinge wherein the top compartment is formed of a first and a second opposing lid joined intermediately by a interlocking latch and slot assembly which is a conventionally used method of joining the upper portion of these type containers. The latch assembly includes interlocking tabs and slots and could be a single latch or a double latch assembly as shown in the instant application. The bottom portion also includes food dividers/walls forming food compartments which could be made in different configurations.

An object of the present invention is to provide a clamshell food container having double opposing interlocking lids for the convenience, protection, and storage of food items. A further object of the present invention is to provide a clamshell food container having double lids which are joined together with an interlocking tab and slot assembly. A further object of the present invention is to provide a clamshell food container wherein the top lids and bottom portions are joined by an integrally formed living hinges. A further object of the present invention is to provide a clamshell food container having double opposing lids so that one lid can be opened on each opposite side of the bottom portion so as to provide receptacles for a user to place food items or condiments therein. A further object of the present invention is to provide a clamshell food container which can be easily operated by a user. A further object of the present invention is to provide a clamshell food container which can be relatively easily and inexpensively manufactured.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
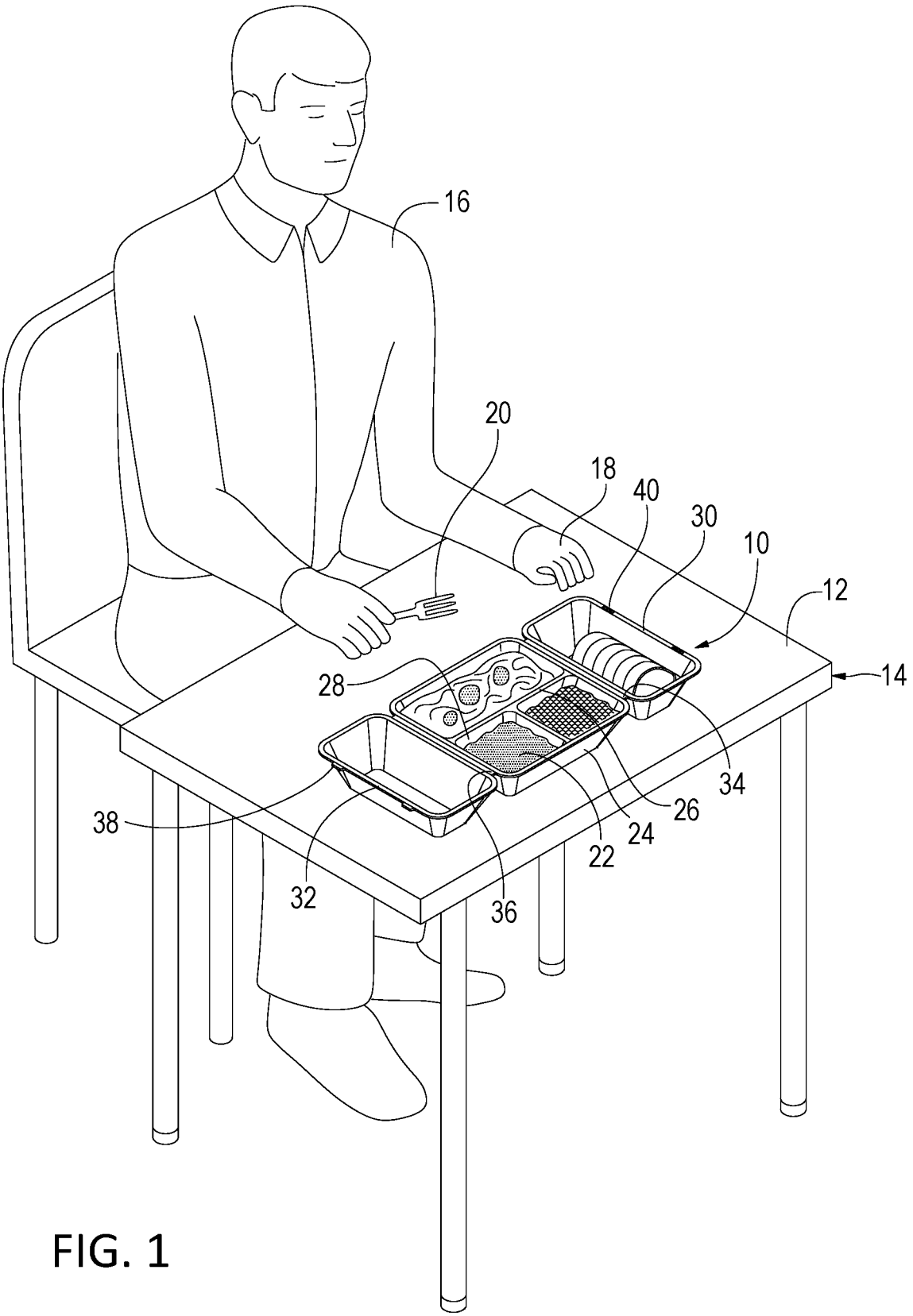
FIG. 1 is a perspective view taken from the rear of the present invention in the open position and containing food items in a plurality of food compartments.

With regard to reference numerals used, the following numbering is used throughout the drawings.

10 present invention
12 table top
14 table
16 user
18 hand of user
20 food utensil/fork
22 food item
24 bottom portion
26 food divider/partition/wall
28 food compartment
30 left upper portion
32 right upper portion
34 left living hinge
36 right living hinge
38 tab
40 slot
42 front wall
44 side wall
46 rear wall
48 side wall
50 upper portion of wall
50F flange
52 floor portion
54 corner
56 front wall
58 side wall
60 rear wall
62 side wall
64 top portion
66 corner

DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 5 illustrate the present invention wherein a clamshell food container having double opposing lids is disclosed and which is generally indicated by reference number 10.

Turning to FIGS. 1-5, and more particularly FIG. 1, therein is shown the present invention 10 situated or positioned on the top 12 of a table 14 disposed in front of a user 16 wherein the user's hands 18 are holding a fork 20 for assisting the user and eating the plurality of food items 22 disposed in the food container 10. The food container 10 has a bottom portion 24 containing food dividers 26 forming a plurality of compartments 28 for containing the food items 22 therein. Also shown are left 30 and right 32 top upper lid portions forming opposing lids which are connected to opposing side walls of the bottom portion by living hinges 34, 36 so that when the top portions are folded toward each other they together form a complete cover for the lower portion 24. Also shown on the top portions are the latching assembly comprising at least one tab 38 and at least one slot 40 which together form an interlocking tab and slot assembly so that the upper lid portions can be secured to each other in a conventional manner when the present invention 10 is in a closed position. It can be seen that the upper lid portions 30, 32 are shown in an open position and which extend from the left and right sides of the central food portion bottom 24 in a symmetrical way so that the lids when in an open position serve as receptacles for food items 22 which, together with the bottom portion 24, form a symmetrical eating platform which is more convenient to a user 16 than conventional clamshell food containers having only a single upper/top portion.

It would be understood by one skilled in the art that clamshell food containers as shown in the present invention 10 are commonly manufactured by thermoforming or can be injection molded into the desired shape and which are commonly composed of a variety of materials such as Styrofoam, polystyrene, polypropylene, PVC, polyester, foam, paper, cardboard, paperboard, or similar type lightweight, semi-flexible material. It is also known that integrally formed hinges 36 which are frequently referred to as living hinges are also commonly used with clamshell food containers. Furthermore, interlocking tabs and slots 38, 40 are also commonly used to join the upper 30, 32 and lower portions 24 together so as to provide an inexpensive latch assembly for closing clamshell food containers, however, snaps, friction fitting, adhesive, staples, heat sealing, or the like can also be used. Conventional clamshell containers are made of one-piece and generally have two-halves joined by a hinge allowing the two halves to come together to close. However, the present invention 10 differs in that it has three portions 24, 30, 32 which come together to close when the two top lids are folded toward each other to form a top for the bottom portion. The intended use of the clamshell food container 10 with double lids is for the convenience, protection, storage, and take-out of multiple food items and could have equal or unequal length sides.

The food dividers 26, which divider may be considered a partition or a wall, which are provided on the inside of the bottom portion 24 could be configured in a number of different layouts or configurations. FIG. 1 shows the present invention in one configuration wherein the larger or entre compartment 28 is shown comprising approximately one-half the size of the bottom portion 24 so that the present invention 10 could be disposed in the manner shown in FIG. 1 so that the entre or larger compartment 28 is disposed toward the hands 18 of the user 16 so that the user could eat an entire meal in a convenient and easy manner. Note the other remaining two food compartments 28 each take up about one-fourth the size of the bottom portion 24. Of course, food compartments 28 could be designed and placed in numerous other configurations as the user would select in the manufacturing process.

Figure 2:
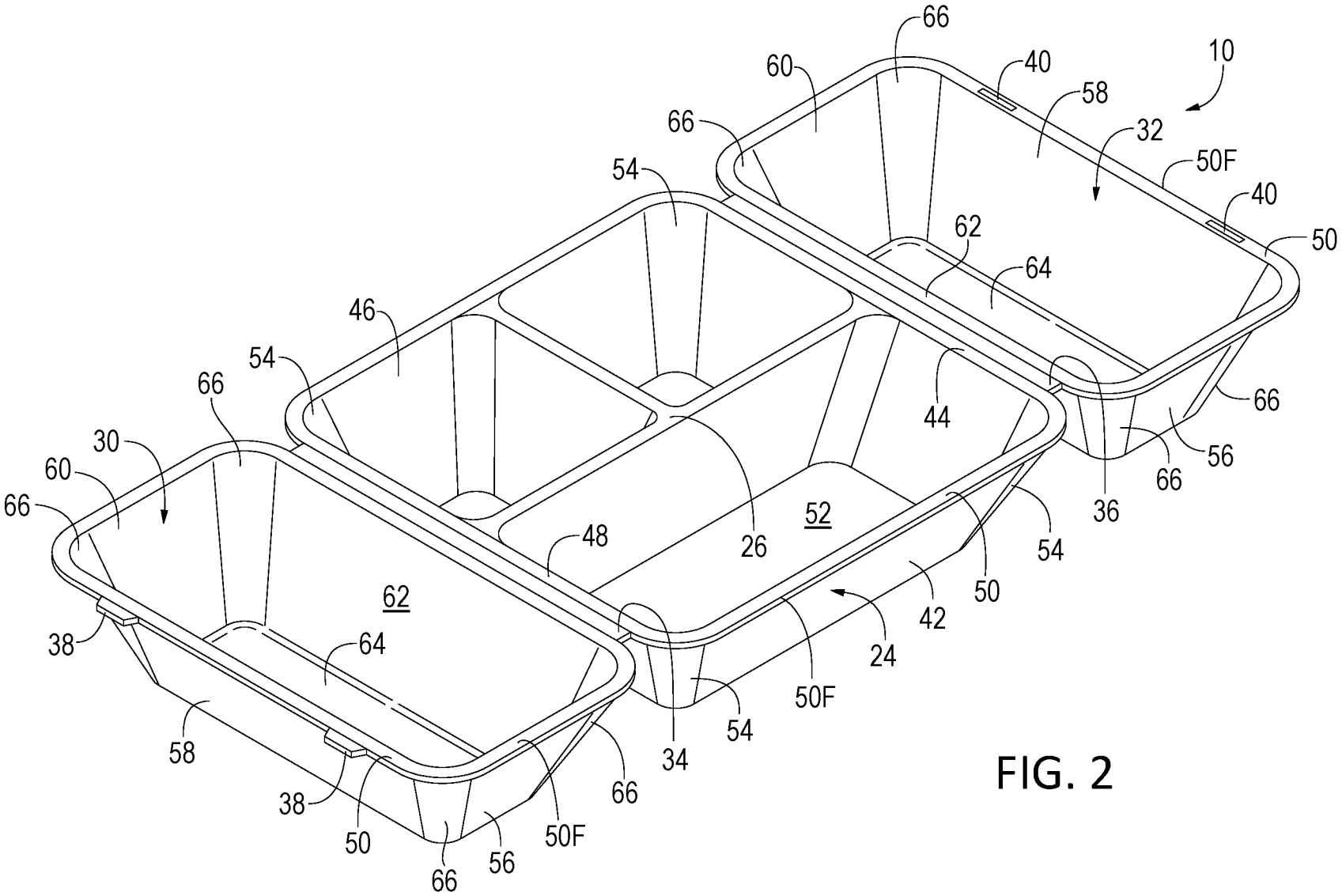
FIG. 2 is a perspective view taken from the front of the present invention in the open position.

Turning to FIG. 2, therein is shown additional features of the present invention 10. Shown therein is the bottom portion 24 having a plurality of walls including front wall 42, opposing side walls 44, 48, and rear wall 46 wherein each wall 42, 44, 46, 48, has an upper portion 50 having an outwardly extending flange 50F which mates with a corresponding, mating flange on the upper portions 30, 32. The bottom portion 24 also includes a floor portion 52 and a plurality of corners 66 disposed in each of the four corners as the bottom portion 24 is rectangular shaped. Each upper portion 30, 32 also includes a wall 56, 58, 60 and 62 including a top portion 64 along with four corners 66 similarly to the bottom portion 24. It can be seen that the tabs 38 extending outwardly from the flange 50F and the slots 40 also are disposed in a flange portion 50F of the top portion 32. Likewise the left living hinge 34 and the right living hinge 36 connect the flanges 50F of each of the remaining portions of the present invention 10.

Figure 3:
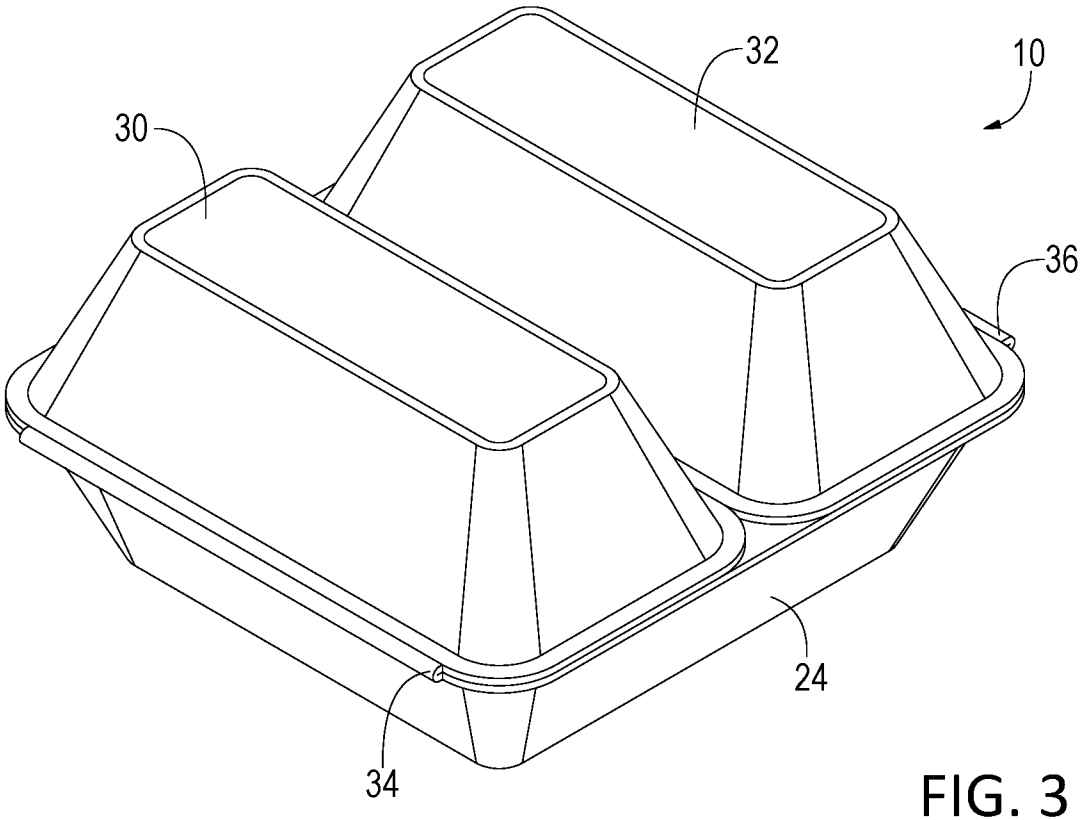
FIG. 3 is a perspective view taken from the front of the present invention in the closed position.
Figure 4:
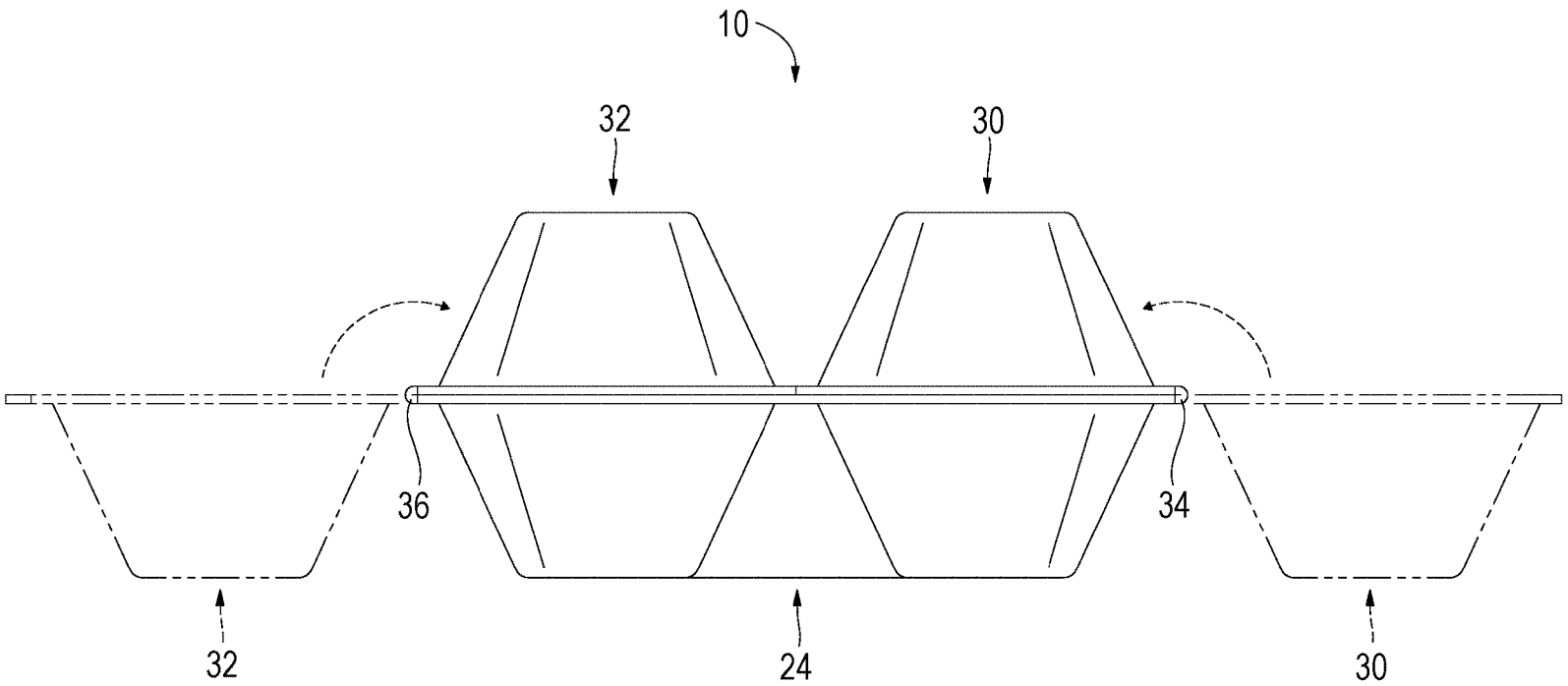
FIG. 4 is a rear elevation view of the present invention.

Turning to FIG. 4, it can be seen that the left upper portion 30 and right upper portion 32 are foldable from an open position as shown in FIG. 2 to a closed position as shown in FIG. 3 and the movement of the left and right upper portions 30, 32 is illustrated using phantom lines in FIG. 4.

Figure 5:
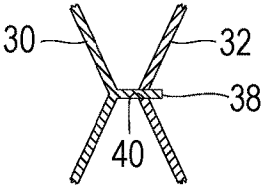
FIG. 5 is a detailed view taken from the front of portions of the present invention illustrating an exemplary locking assembly for joining the upper opposing lids to the bottom portion.

Turning to FIG. 5, therein is shown a detailed view of portions of the present invention 10 illustrating an exemplary locking assembly for securing the upper opposing lids 30, 32 to the bottom portion 24 wherein a tab 38 is inserted into the slot 40 as would be done when the present invention 10 is in a closed position as shown in FIGS. 3 and 4.

One skilled in the art would understand that the term plastic includes many types of synthetic material made from organic polymers such as, e.g., PVC, polyethylene, polystyrene, polypropylene, and nylon which can be easily shaped and molded.

Left and right side, and, front and rear designations regarding the present invention 10 are interpreted from the view of the user 16 facing toward the present invention 10 as shown in FIG. 1. Also, lines with arrowheads are sometimes placed on drawings to indicate potential motion or direction of movement of an item illustrated in the drawing.

I claim:

1. A method of making and using a food container for the convenience, protection, and storage of food items, comprising the steps of:

a) providing a bottom of said container having first and second opposing side walls and partitions forming compartments for containing an entire ready to eat meal;

b) providing a first and second lid, wherein the first lid is hingedly connected to the first side wall and the second lid is hingedly connected to the second side wall so that the first and second lids are each foldable from an open position to a closed position;

c) a user securing the first lid to the second lid in the closed position by inserting a tab extending from a flange along an outer edge of said first lid facing said second lid into a slot in a flange along an outer edge of said second lid facing said first lid;

d) said or other user releasing said tab from said slot and unfolding said lids from said closed position to said open position;

e) said or other user proceeding to eat said meal directly from said bottom of said container; and f) wherein said first and second lids are provided with multiple tabs and slots for receiving the tabs.

2. The method of claim 1, wherein each first and second lid is about one-half the width of the distance between the first and second opposing side walls of the bottom.

3. The method of claim 1, wherein the bottom is covered when the first and second lids are in the closed position.

4. The method of claim 1, wherein the first and second lids are hingedly connected to the bottom using a living hinge.

5. The method of claim 1, wherein the food container is rectangular shaped.

6. The method of claim 1, wherein the food container is comprised of plastic.

* * * * *